US005982503A

United States Patent [19]

Miyamoto et al.

[11] Patent Number: 5,982,503

[45] **Date of Patent: *Nov. 9, 1999**

[54] IMAGE FORMING APPARATUS WITH CONTROL COORDINATING PRESSURE ROLLER AND POWER ACTIVATION

[75] Inventors: Kazuki Miyamoto; Naoyuki Ohki, both of Yokohama; Masaki Nakano, Ebina; Takahiro Ushiro; Yasuo Fukazu, both of Kawasaki; Atsushi Chaki, Yokohama; Shinichi Takata, Kawasaki; Kazuhiro Ohyoshi, Wakoh, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/514,249

[22] Filed: Aug. 11, 1995

[30] Foreign Application Priority Data

Aug. 12, 1994 [JP] Japan ..... 6-210789

[51] Int. Cl.[6] ..... G03G 15/20

[52] U.S. Cl. ..... 358/400; 358/500

[58] Field of Search ..... 358/400, 500, 358/503, 296–298; 399/328, 330–331

[56] References Cited

U.S. PATENT DOCUMENTS

| | | | |
|---|---|---|---|
| 4,117,498 | 9/1978 | Edwards et al. | 346/74.1 |
| 4,870,526 | 9/1989 | Maruta et al. | 361/1 |
| 5,040,075 | 8/1991 | Takayanagi | 358/300 |
| 5,149,941 | 9/1992 | Hirabayashi et al. | 219/216 |
| 5,253,025 | 10/1993 | Mitsuya et al. | 355/285 |
| 5,325,117 | 6/1994 | Huh et al. | 346/108 |
| 5,410,419 | 4/1995 | Muramatsu et al. | 358/468 |

*Primary Examiner*—Thomas D. Lee
*Assistant Examiner*—Stephen Brinich
*Attorney, Agent, or Firm*—Fitzpatrick, Cella, Harper & Scinto

[57] ABSTRACT

An image forming apparatus includes a heater for generating heat upon reception of electric energy; a film movable with a recording material having an unfixed image; and a pressure roller for forming a nip with the heater, with the film interposed therebetween; wherein the pressure roller starts to rotate at the same time as a main power switch of the apparatus is turned on.

5 Claims, 12 Drawing Sheets

IMAGE FORMING APPARATUS WITH CONTROL COORDINATING PRESSURE ROLLER AND POWER ACTIVATION

FIELD OF THE INVENTION AND RELATED ART

The present invention relates to image forming apparatuses such as copying machines, printers, or facsimiles, in particular, those comprising fixing means for fixing an unfixed image to recording medium, wherein the image is fixed in a nip formed between a heater and a pressure roller, with a piece of film, which moves with the recording medium, being interposed in the nip.

In the fixing apparatus, such as the one disclosed In U.S. Pat. No. 5,149,941, comprising a piece of film, a heater and a pressure roller, a nip, in which the film is interposed, is formed for pinching recording medium.

When the film and pressure roller in such an apparatus are left stationary for a long time, the nip forming portion of the pressure roller becomes deformed. If a fixing operation is started while the pressure roller is in the aforementioned condition, image fixation becomes nonuniform.

SUMMARY OF THE INVENTION

The present invention was made in consideration of the aforementioned shortcoming, and its primary object is to provide an image forming apparatus which does not cause the nonuniform fixation.

According to an aspect of the present invention, the trace of the nip in an image forming apparatus is removed from the pressure roller before a fixing operation is started.

According to another aspect of the present invention, an image forming apparatus comprises: a heater which generates heat upon power reception; a piece of film which moves with recording medium carrying an unfixed image; and a pressure roller which forms a nip in conjunction with the heater, with the film being interposed in the nip; wherein the pressure roller begins rotating at the same time as the main power switch of the main assembly of the image forming apparatus is turned on.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 11 is a graph showing the correlation between the power supply and heater temperature, immediately after the film and pressure roller begin to rotate as the main power switch is turned on.

FIG. 13 is a graph showing the correlation between the power supply and heater temperature, immediately after the film and pressure roller begin rotating as the main power switch is turned on.

DESCRIPTION OF THE PREFERRED EMBODIMENTS

Figure 1:
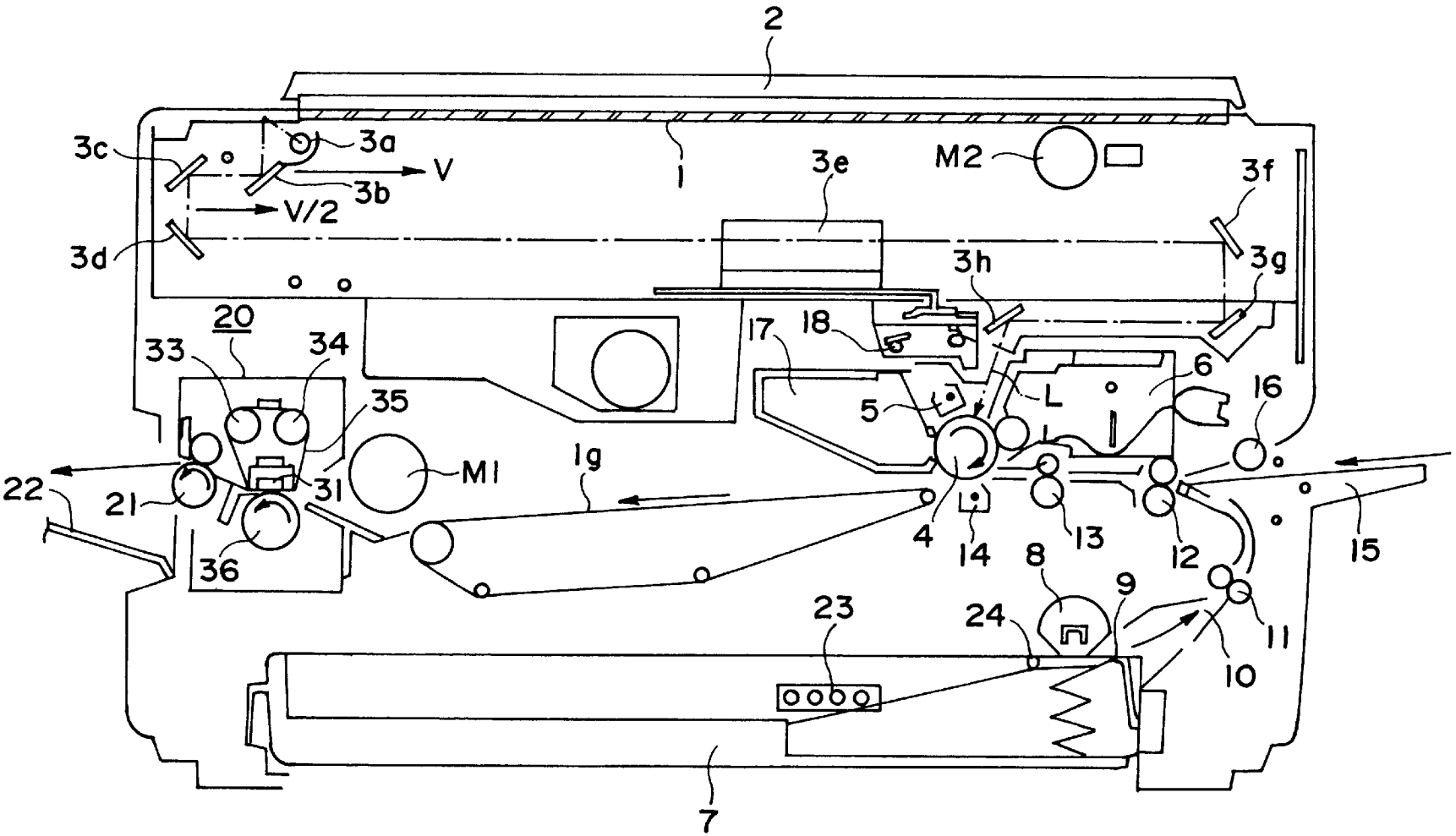
FIG. 1 is a sectional side view of the general structure of an image forming apparatus in accordance with the present invention.

To begin with, the first embodiment of the present invention will be described with reference to FIGS. 1–11. FIG. 1 is a sectional side view of the general structure of an embodiment of the image forming apparatus in accordance with the present invention, which comprises an image heating apparatus. The image forming apparatus in this embodiment is an electrophotographic copying machine of a transfer type, which comprises a combination of a stationary original table and a moving optical system.

In FIG. 1, a reference numeral 1 designates a glass original table. An original is set of this table, being aligned with a predetermined referential mark, and covered with an original pressing plate 2, wherein the original surface bearing the image to be copied faces downward.

As the copy-start button is depressed after an original is set, a copy-start signal is outputted, and an original exposing lamp 3*a* is turned on in response to this copy-start signal. This original exposing lamp 3*a* and a first mirror 3*b* move rightward from their home positions on the left-hand side, at a predetermined speed V along the bottom surface of the glass original table 1, and a second mirror 3*c* and a third mirror 3*d* also move in the same direction as the original exposing lamp 3*a* and first mirror 3*b*, at a speed of V/2, As a result, the image on the downward facing surface of the original set on the glass original table 1 is scanned left to right with the light from the exposing lamp 3*a*.

A light L, that is, the scanning light reflected by the surface of the original, is projected by way of an image forming lens 3*c*, a fourth mirror 3*f*, a fifth mirror 3*g*, and a sixth mirror 3*h*, onto the surface of an electrophotographic photosensitive member 4 of a drum type, at a predetermined point, forming thereon a slit image of the original, by which the surface of the photosensitive member 4 is sequentially exposed. The photosensitive drum 4. which is rotated at a predetermined peripheral velocity in the clockwise direction indicated by an arrow mark, is uniformly charged to predetermined polarity and potential by a primary charger 5, before it is exposed as described above.

Therefore, as the charged surface of the photosensitive member 4 is exposed as described above, an electrostatic latent image, in correspondence with the original image, is formed on the surface of the photosensitive drum 4. Then, the latent image is developed as a toner image by a developing unit 6.

Meanwhile, sheets of recording medium stored in a sheet feeder cassette 7 are separated and fed out one by one through the coordination of a feeder roller 8 and a separator claw 9. Then the recording medium is conveyed by way of a sheet path 10, a conveyer roller 11, a conveyer roller 12, and a register roller 13, and is introduced, with a predetermined timing, to a transfer station located between the photosensitive drum 4 and a transfer unit 14. In some cases, the recording medium sheet is inserted through a manual multi-feeder section 15, and also is introduced, with a predetermined timing, to the aforementioned transfer station through a feeder roller 16, the conveyer roller 12, and the register roller 13.

In the transfer station, the toner image, having been formed on the surface of the photosensitive drum 4 in the aforementioned manner, is sequentially transferred onto the recording medium. As the recording medium comes out of the transfer station, it is separated from the surface of the photosensitive drum 4, setting on the belt of a conveyer unit 19. It is introduced into a fixing unit 20, in which it is subjected to a thermal fixation process, and then is discharged, as a finished copy, into an external discharge sheet tray 22 by a sheet discharger roller 21.

After the toner image is transferred onto the recording medium, the surface of the photosensitive drum 4 is cleaned by a cleaning unit 17, which removes the toner or the like residue remaining on the surface of the photosensitive drum 4, and also, the residual potential is removed by an exposure lamp 18, so that the photosensitive drum can be repeatedly used for image formation.

In the apparatus of this embodiment, the sheet feeder section, conveyer section, photosensitive member, fixing section, and the like are driven by a brushless DC motor M1 as the main driving force source, and the optical system (including the image reading mechanism) is driven by a stepping motor M2. In this embodiment, the output of the phase excitation signal applied to each phase, A, A±, B or B± of this stepping motor is switched between two modes, that is, the two-phase excitation mode and single-two-phase excitation mode, in response to the speed data set according to the load.

As for the sheet feeding system, there are two choices: the sheet may be fed from the sheet feeder cassette 7 as described before, or may be manually fed through the manual multi-feeder section 15. When the recording medium sheet is fed using the sheet feeder cassette 7, the state of sheet feeding operation is controlled by a switch group 23, which detects the pressure or absence of the sheet feeder cassette 7, and also, detects the size of the sheet stored therein, and a switch 24, which defects the presence or absence of the sheet in the sheet feeder cassette 7, wherein, when an anomaly is detected by the switches 23 and 24, the nature of the anomaly is displayed on a monitor. When the recording medium is manually fed through the manual multi-feeder section, the state of feeding is controlled by a switch (unillustrated) capable of detecting the state of feeding through the manual multi-feeder section, and as an anomaly is detected, the nature of the anomaly is displayed on the monitor.

Figure 2:
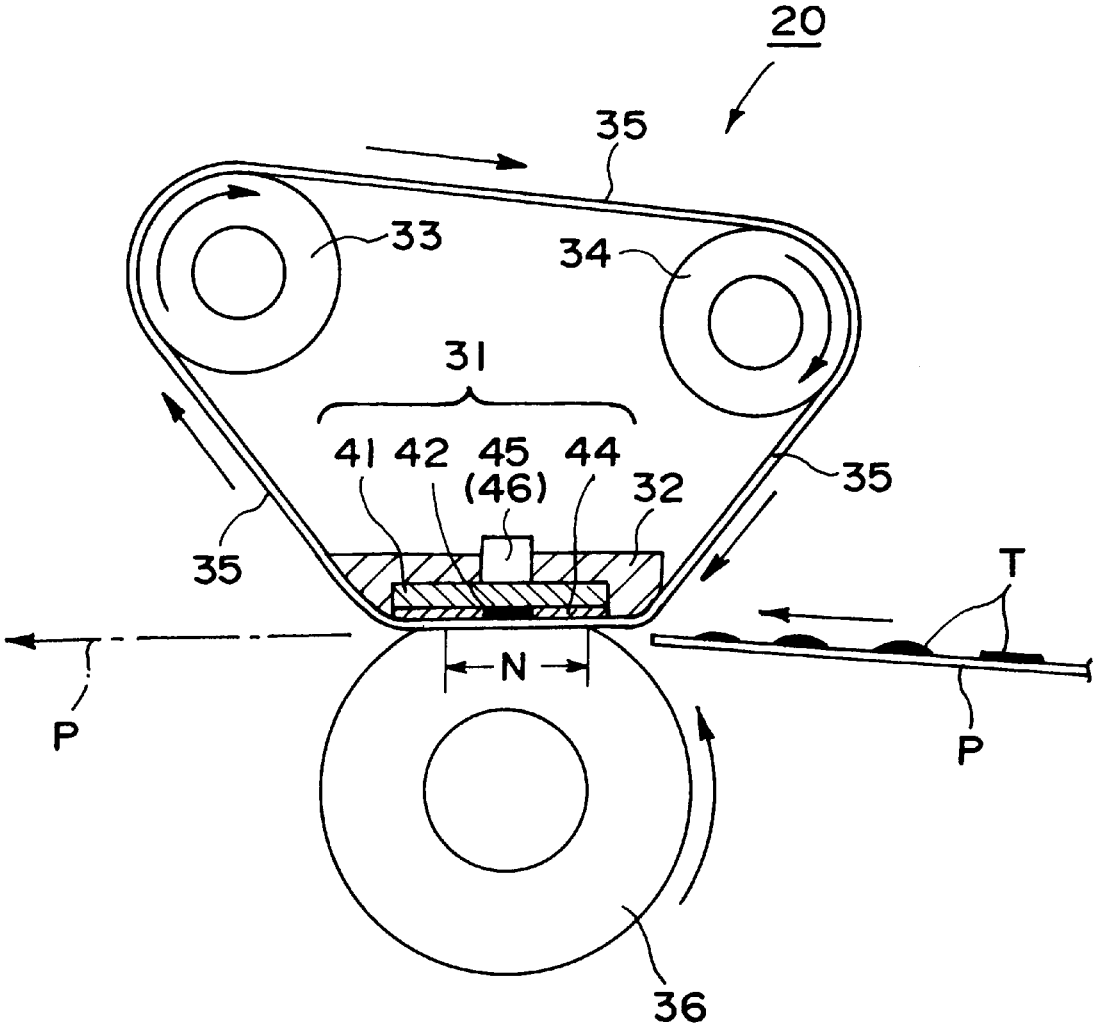
FIG. 2 is a sectional side view of the general structure of the fixing unit employed in an image forming apparatus in accordance with the present invention.
Figure 3:
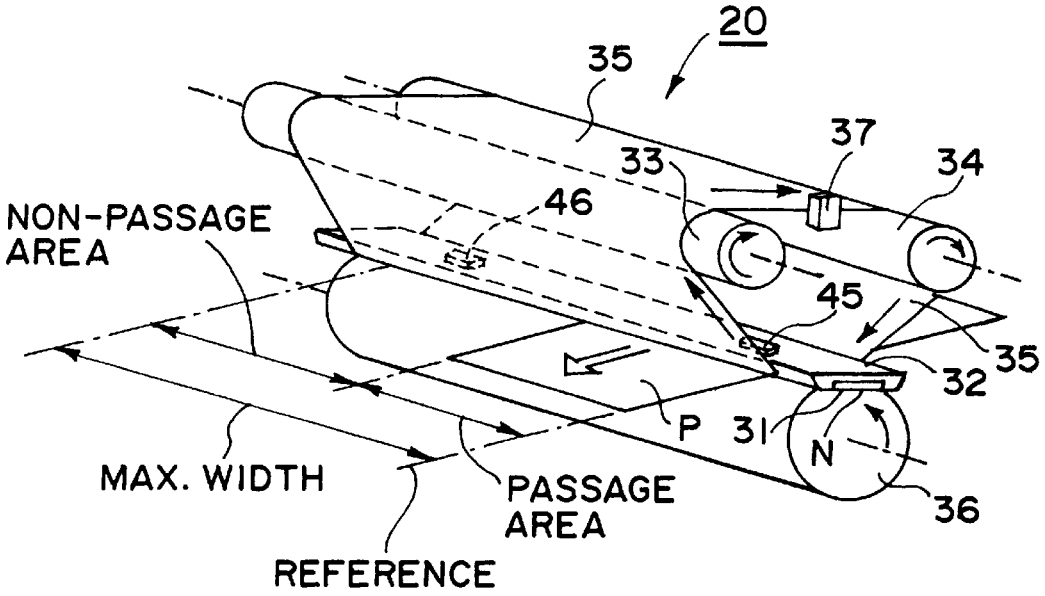
FIG. 3 is a perspective view of the fixing unit illustrated in FIG. 2.
Figure 4:
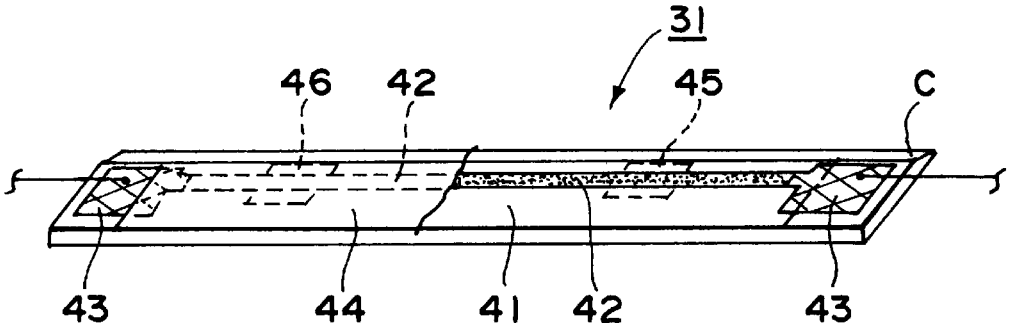
FIG. 4 is a partially cutaway perspective view of the heating member in the fixing unit of FIG. 2, wherein the heater surface which comes in contact with the fixing film is facing upward.

Next, the fixing unit 20 of this embodiment will be described in detail. The fixing unit of this embodiment is a heating apparatus of a through-film heating type, that is, a heating apparatus in which the heat is transmitted through a piece of film. FIG. 2 is a sectional side view of the general structure of such a fixing unit 20; FIG. 3, a perspective view thereof; and FIG. 4 is a partially cutaway perspective view of a heating member.

A reference numeral 31 designates a heating member (hereinafter, a heater), which is fixedly supported on the bottom surface of a heat resistant plastic supporter 32, with its heat generating surface facing downward. Reference numerals 33 and 34 designate a film driver roller and a film tensioner roller, respectively. These three members, the two rollers 33 and 34 and the plastic supporter 33 of the heater 31, are arranged substantially in parallel to each other, and an endless belt of heat resistant film 35 (hereinafter, a fixing film) is stretched around the plastic supporter 32, roller 33, and roller 34.

Reference numeral 36 designates a pressure roller, which presses the fixing film 35 onto the bottom surface of the heater 31. An alphabetic reference N designates a pressure nip (fixing nip or heating nip) formed between the heater 31 and Pressure roller 36, with the fixing film 35 being interposed therein. The pressure roller 36 is a roller with an elastic layer composed of rubbed material such as silicone rubber having high releasing property and is placed in contact with the bottom surface of the heater 31, with an overall contact pressure of 4–10 kg, for example.

As the driver roller 33 is rotatively driven in the clockwise direction, the fixing film 35 is rotatively driven in the clockwise direction at a predetermined peripheral velocity, that is, substantially the same speed as the speed at which a recording medium P is conveyed from the aforementioned toner image transfer station, and is introduced into the fixing unit 20, by the conveyer unit 19 (FIG. 1), wherein correction is made so as to prevent the recording medium P from wrinkling, snaking, or delaying. More specifically, in this embodiment, a regulator member 37 such as the one illustrated in FIG. 3 is provided to detect the film shift and/or prevent the film from shifting, and the film is prevented from snaking by a film shift regulating mechanism (unillustrated), in response to the signal from this regulator member 37. It should be noted here that the pressure roller 36 is rotated by the fixing film 35.

As the recording medium P is introduced into the pressure nip N formed between the fixing film 35 and pressure roller 36, with the fixing film 35 as well as the pressure roller 36 being rotatively driven, and also, with the heater 31 generating the heat, the recording medium P is tightly placed in contact with the surface of the fixing film 35, and is pinched through the nip N together with the film 35, whereby the recording medium P is subjected to the heat from the heater 31 through the fixing film 35, being heated thereby. As a result, an unfixed toner image T on the recording medium P is fixed to the surface of the recording medium P by the heat and pressure. Thereafter, the recording medium P having being passed through the pressure nip N is separated from the surface of the rotating fixing film 35 by the curvatures of the pressure roller 36 and fixing film 35.

Since the fixing film 35 is repeatedly used for thermally fixing the toner image as described above, such film that is superior in heat resistance, releasing property, durability, and the like properties is used as the fixing film 35. Generally speaking, its overall thickness is not more than 100 $\mu$m, preferably, not more than 40 $\mu$m.

For example, there are a monolayer film of heat resistant resin such as polyimide, polyetherimide, PES, PFA (tetrafluorostyrene-perfluoroalkylvinylether copolymer resin), or the like; or multi-layer film comprising, for example, a 20 $\mu$m thick base layer, and a 10 $\mu$m thick parting layer of fluoro-resin such as PTFE (tetrafluoro-ethylene resin), PAF, or the like, which is coated on the base layer, on the surface which comes in contact with the image on the recording medium P as the material to be heated, and contains electrically conductive material.

Referring to FIGS. 2 and 4, the heater 31 as the heating member is a linear heating member with a small overall thermal capacity, and comprises a heater substrate 41, a heat generating resistor 42, a pair of power supply electrodes 43, a heat resistant overcoat layer 44, and the like. The heater substrate 41 is heat resistant, electrically insulating, and thermally conductive, and extends in the direction perpendicular to the moving direction of the fixing film 35, that is, the moving direction of the recording medium P. The heat generating resistor 42 is formed on the outward facing surface of the substrate 41, in such a manner as to extend in the longitudinal direction of the substrate 41, on the substantial center line relative to the widthwise direction of the substrate 41. The power supply electrodes 43 are located at the corresponding longitudinal ends of the heat generating resistor 42. The overcoat layer 44 protects the heater surface on which the heat generating resistor 42 is.

Referring to FIG. 4, the heater substrate 41 is polished so that one of its long edges facing the pressure nip. N side as shown in FIG. 2 is rounded, or given a curvature (let this curved surface be called surface C). This surface C plays the role of preventing the recording medium P from being curled. Precisely speaking, the heat generating resistor 42 is not disposed at the dead center relative to the widthwise direction of the heater substrate; it is slightly displaced toward the surface C. The heater 31 is fixedly supported on the plastic supporter 32, and its surface, carrying the heat generating resistor 41, is exposed downward.

The supporter 32 may be composed of highly heat resistant resin such as PPS (polyphenylene sulfide), PAI (polyamideimide), PI (polyimide), PEEK (polyetheretherketon), or liquid crystal; or compound material composed of these resins, and ceramics, metal or glass.

The heater substrate 41 is formed of electrically insulating, thermally conductive material such as alumina or aluminum nitride, and is 1 mm in thickness, 10 mm in width, and 240 mm in length. The heat generating resistor 42 is constituted of a layer of screen printed pattern of electrically resistive material such as Ag/Pd, $RuO_2$ or $Ta_2N$, and is several millimeters in width and 10 $\mu$m in thickness. The power supply electrode 43 is constituted of a patterned layer of electrically conductive material such as Ag, Cu or AU. The heat resistant overcoat layer 44 is a heat resistant glass layer, for example.

As a voltage is applied between the power supply electrodes 43 and 43 of the heater 31 constructed as described above, electrical power is supplied to the heat generating resistor 42, causing the heat generating resistor 42 to generate heat, which quickly increases the temperature of the heater 31 including this heat generating resistor 42.

On a metallic stay (unillustrated) attached for reinforcing the plastic supporter 32, first and second temperature detecting elements (thermisters) 45 and 46 for detecting the temperature of the heater 31 are mounted in direct contact with the inward facing surface (back surface of the heater substrate) of the heater 31.

The first temperature detecting element 45 is disposed on the inward facing surface of the heater, at a location which corresponds to the path of a recording medium having the smallest acceptable width for the apparatus (heater region where a recording medium of any size passes). The second temperature detecting element 46 is disposed on the inward facing surface of the heater, at a location which corresponds to the heater region where a small size recording medium does not pass; in other words, it is positioned on the inward facing surface of the heater, at a location closer to the side opposite to the side where the sheet alignment reference is disposed (in this embodiment, the edge alignment system is employed).

The aforementioned second temperature detecting element 46 is used to increase the recording medium intervals during a continuous copying operation, so as to prevent temperature increase in the area where the recording medium does not pass, since when a small size recording medium is passed, the temperature increases across the heater portion where the recording medium does not pass.

As described above, as the power is supplied to the heat generating resistor 42 of the heater 31, the heat generating resistor 42 generates heat, which quickly increases the temperature of the heater 31 across almost its entire length. This temperature increase is detected by the first temperature detecting element 45, and the detected temperature is fed back to a temperature control system, which controls the power supply to the heat generating resistor 42, in such a manner that the temperature of the heater 31 is maintained at a predetermined fixing temperature.

Figure 6:
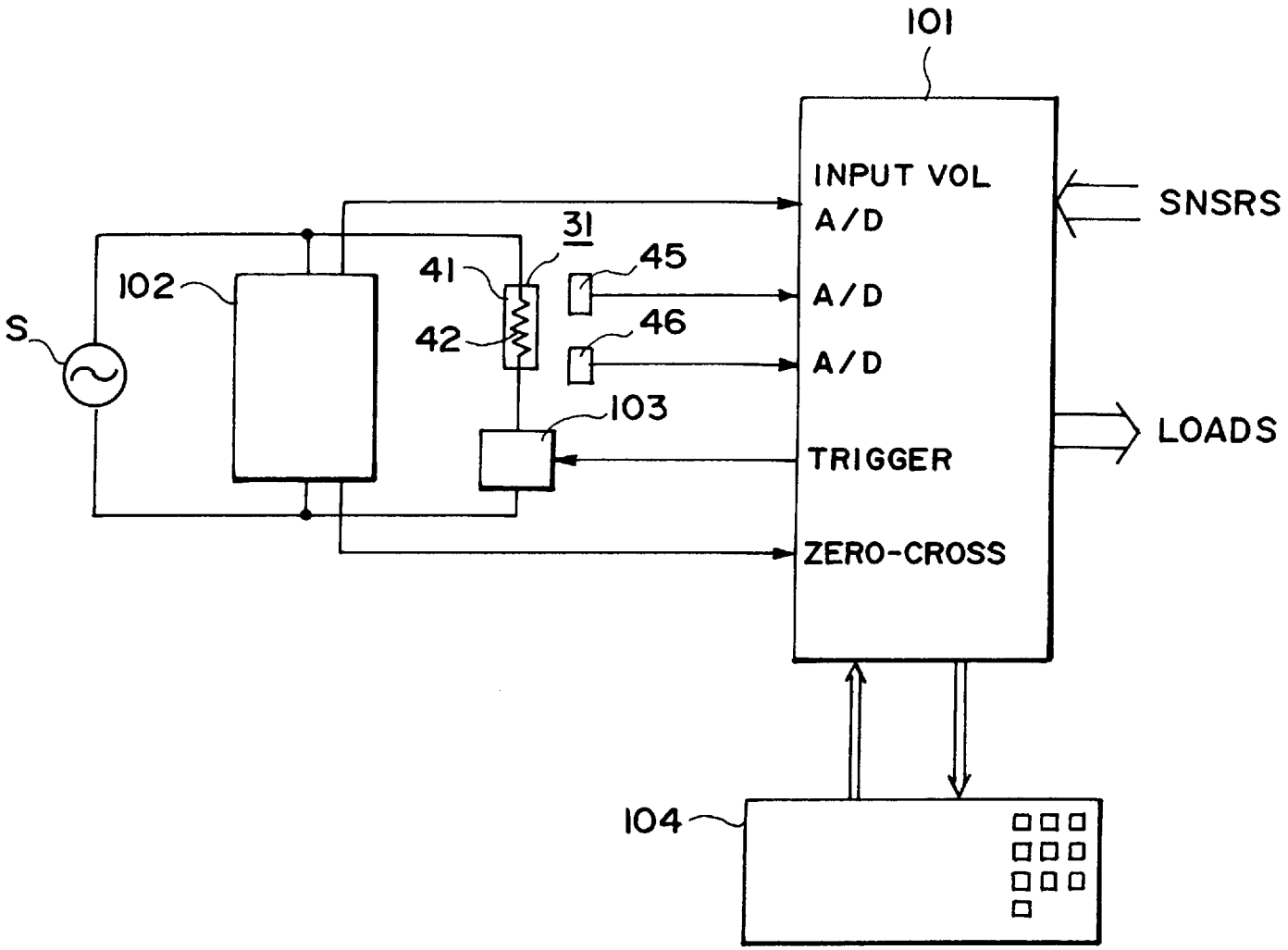
FIG. 6 is a block diagram of the heater control section in the fixing unit of FIG. 2.

FIG. 6 is a block diagram of the heater control section. Reference numeral 101 designates a controller for controlling the power supply to the heater 31, which results in controlling the temperature of the heater; 102, a circuit for detecting the input voltage of a commercial AC power source as the power source; and 103 designates a switching circuit for switching voltages applied to the heat generating resistor 42 of the heater 31.

The controller 101 inputs the AC input voltage value to the A/D of the controller 101 through the input voltage detecting circuit 102. This is an effective value Erms of the input voltage. Also, the outputs of the first and second temperature detecting elements 45 and 46 are inputted to the A/D of the controller 101. As for the resistance value of the heat generating resistor 42 of the heater 31, the resistance value measured in advance at the normal temperature is recorded on the fixing unit 20, and this resistance value is inputted to the nonvolatile memory of the controller 101, using a console section 104.

Also in this embodiment, a zero-cross signal is derived from the AC input, and is inputted, as an interrupt signal, to the controller 101, wherein this trigger signal serves as the timing signal for controlling the phase of the power supply to the heat generating resistor 42 of the heater 31.

Next, it will be described how the power supply to the heater 31 is controlled in this embodiment. As for the shortcomings of a heater comprising a heat generating resistor such as the one employed in this embodiment, there are occurrences of large ripples as well as the aforementioned deformance.

Therefore, in this embodiment, in order to reduce thee ripples, the power supply to the heater 31 is switched in response to the heater temperature detected by the first temperature detecting element 45. For example, during a copying operation, the power is supplied in accordance with the temperature as shown in the following table, wherein $T_0$ is a target temperature; $T_1$, a temperature of the first thermister; $W_0$, the maximum applicable power (100% duty); and W is the applied power.

TABLE 1

| | |
|---|---|
| $T < T_0 - 3$ | $W = W_0$ |
| $T_0 - 3 \leqq T < T_0$ | $W = 0.8\ W_0$ |
| $T_0 \leqq T < T_0 + 6$ | $W = 0.6\ W_0$ |
| $T_0 + 6 \leqq T < T_0 + 12$ | $W = 0.3\ W_0$ |
| $T_0 + 12 \leqq T$ | $W = 0$ |

The power supply to the heater 31 is controlled in the same manner as that to the exposure lamp 3*a*, using the following phase control.

First, since the heater 31 (first generating resistor 42) serves as a purely resistive load, the power W is:

$$W=(V_H)^2/R$$

$V_H$: voltage applied to heater

R: resistance value of heater

The resistance value of the heater 31 (heat generating resistor 42) is quite variant, that is, is difference among the image forming apparatuses; therefore, it is so arranged that it can be inputted to the nonvolatile memory through the console section 104 as described above. Thus, in this embodiment, in order to equalize the power supply to the heater 31, at a predetermined value, the voltage $V_H$ to be applied to the heater 31 is derived from the above formula:

$$(V_H)^2=R\times W \tag{1}$$

Substituting V with the effective voltage value formula:

$$V_H = \sqrt{\frac{\int TH^{T/2} E^2 \max \mathrm{SIN}^2(2\pi/T)t dt}{T/2}} \tag{2}$$

$$V_H{}^2 = E\mathrm{rms}^2(1-(2T_H/T)+(1/2\pi)\mathrm{SIN}(4\pi T_H/T))$$

$$E\mathrm{rms}^2/V_H{}^2 = 1/\{1-2\times T_H/T+\mathrm{SIN}(4\pi T_H/T)2\pi\}$$

Therefore, a time $T_H$ from the zero-cross signal to the trigger signal for the heater can be obtained from the formula (2) by obtaining the value of $(V_H)^2$ from the formula (1); obtaining the value of $\mathrm{Erms}^2$ from the value detected by the AC input voltage detecting circuit 102; and thereby, obtaining the value of $\mathrm{Erms}^2/(V_H)^2$. It should be noted here that in this embodiment; the value of $T_H$ is obtained from $\mathrm{Erms}^2/(V_H)^2$, using a table.

Figure 7:
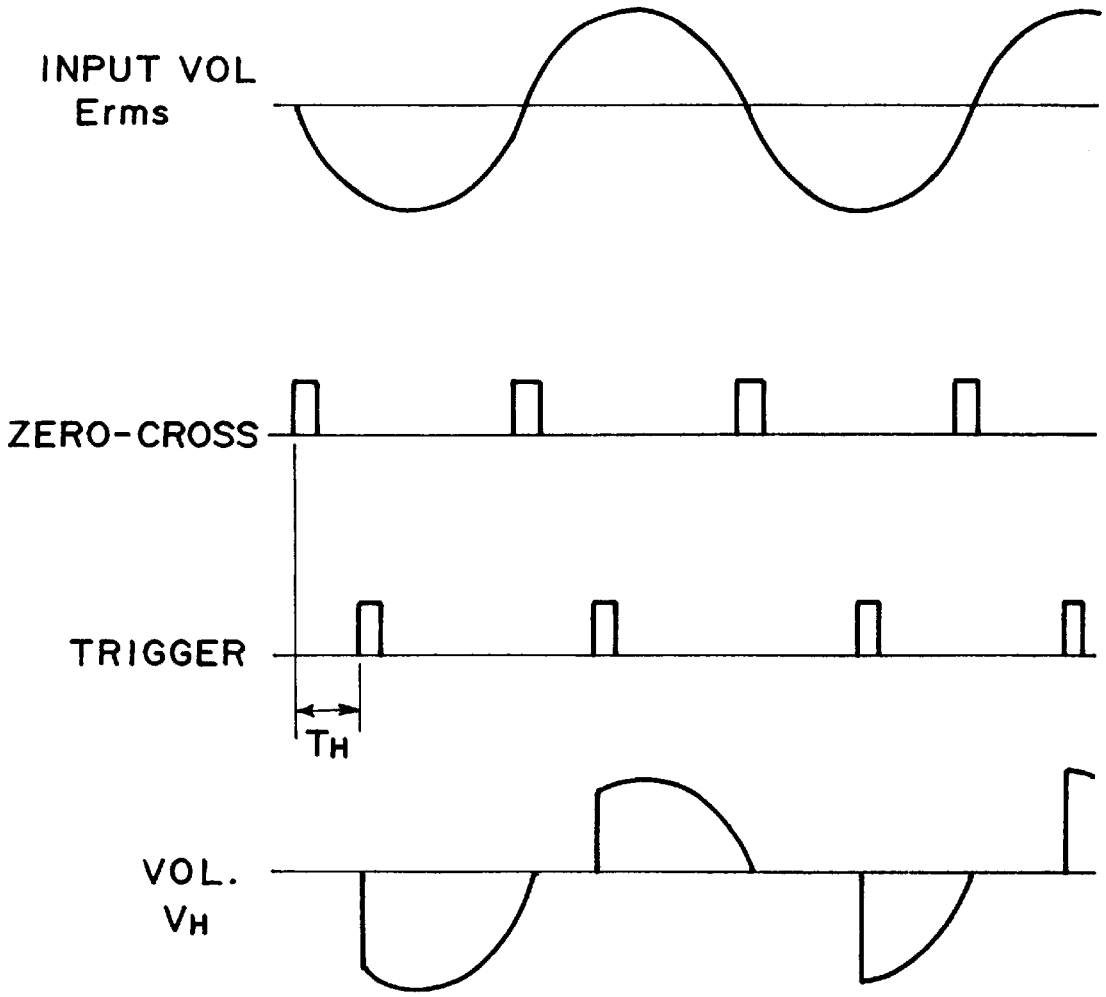
FIG. 7 is an explanatory drawing describing the phase control for the heater in the first embodiment of the present invention.

In this embodiment, the power supply to the heater 31 is controlled using such an algorithm as described above; therefore, the power applied to the heater 31 is maintained at a predetermined value as shown in FIG. 7.

Next, referring to FIGS. 8–11, a power supply sequence for the heater will be describe. To begin with, referring to FIG. 8, the moment the main power switch of the apparatus main assembly is turned on, the main motor M1 begins to be rotated at a predetermined revolution for a predetermined duration, and the stepping motor M2, which is the motor for the optical system, is driven to move the optical system to the home position (step S201 in FIG. 9).

Figure 8:
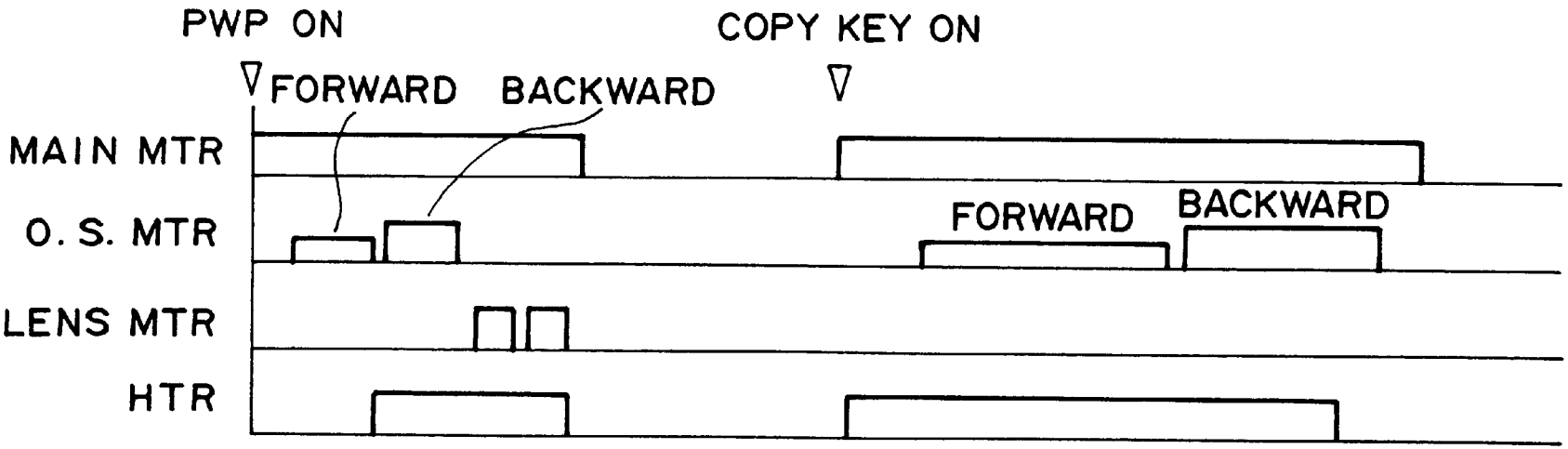
FIG. 8 is a timing chart for controlling the image forming apparatus in the first embodiment of the present invention.

Since the rotations of the film 35 and pressure roller 36 begin at the same time as the power switch is turned on, the trace of the nip on the pressure roller can be removed before a fixing operation begins. After the power switch is turned on, the film and pressure roller are rotated for a predetermined duration. In order to remove the nip trace on the pressure roller more effectively, the power is also supplied to the heater 31 during the rotations of the film and pressure roller which begins the moment the power switch is turned on. More specifically, the application of power to the heater 31 is started a predetermined time after the main power switch is turned on as shown in FIG. 8, and the power supplied at this time is a power $W_1$, which is smaller than the power $W_0$ supplied during the warm-up period at the beginning of a fixing operation (step S202 in FIG. 9).

The reason why the power to be supplied to the heater 31 while the film and pressure roller are rotated immediately after the main power switch is turned is rendered smallar than the power supplied to the heater 31 during the warm-up period at the beginning of a fixing operation is as follows.

Figure 5:
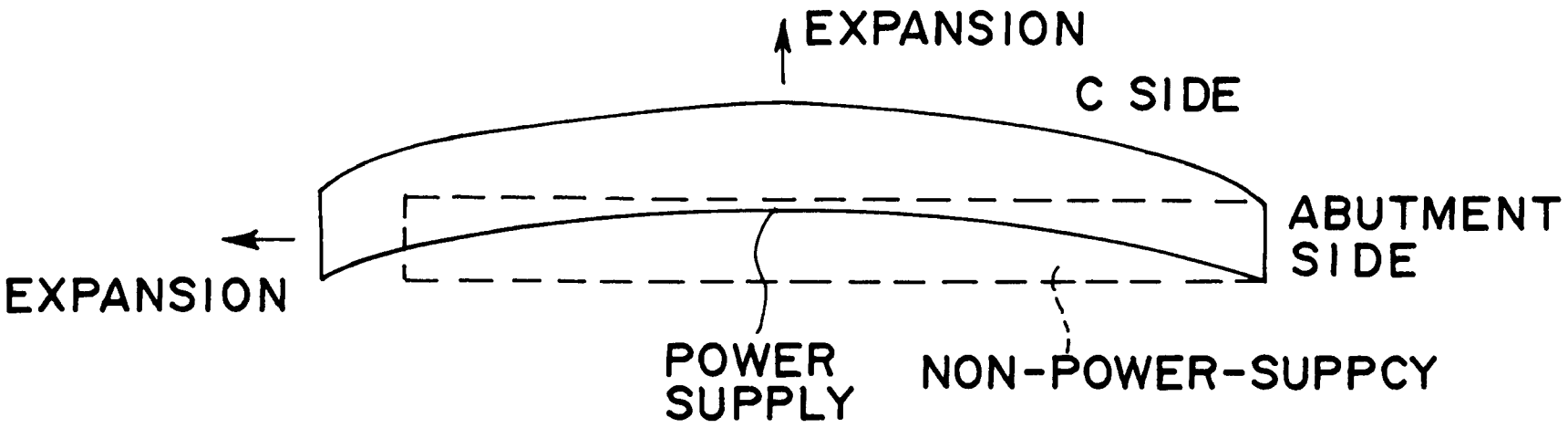
FIG. 5 is an explanatory drawing describing the heater deformation in the fixing unit of FIG. 2.

That is, if a large amount of power is supplied to the heater 31 when the image forming apparatus is cold, the heater 31 suddenly expands in the longitudinal direction, and also warps toward the surface C as shown in FIG. 5. This phenomenon occurs because the thermal expansion coefficient of the heat generating resistor 42 is larger than that of the heater substrate 41. The heater 31, constituted of the heat generating resistor 42 and substrate 41, is supported on the plastic supporter 32, and there is no gap between the heater 31 and supporter 32, in the widthwise direction of the heater 31 (direction of the recording medium path); therefore, the heater warps toward the surface C. and this warping damages the heater 31.

Figure 10:
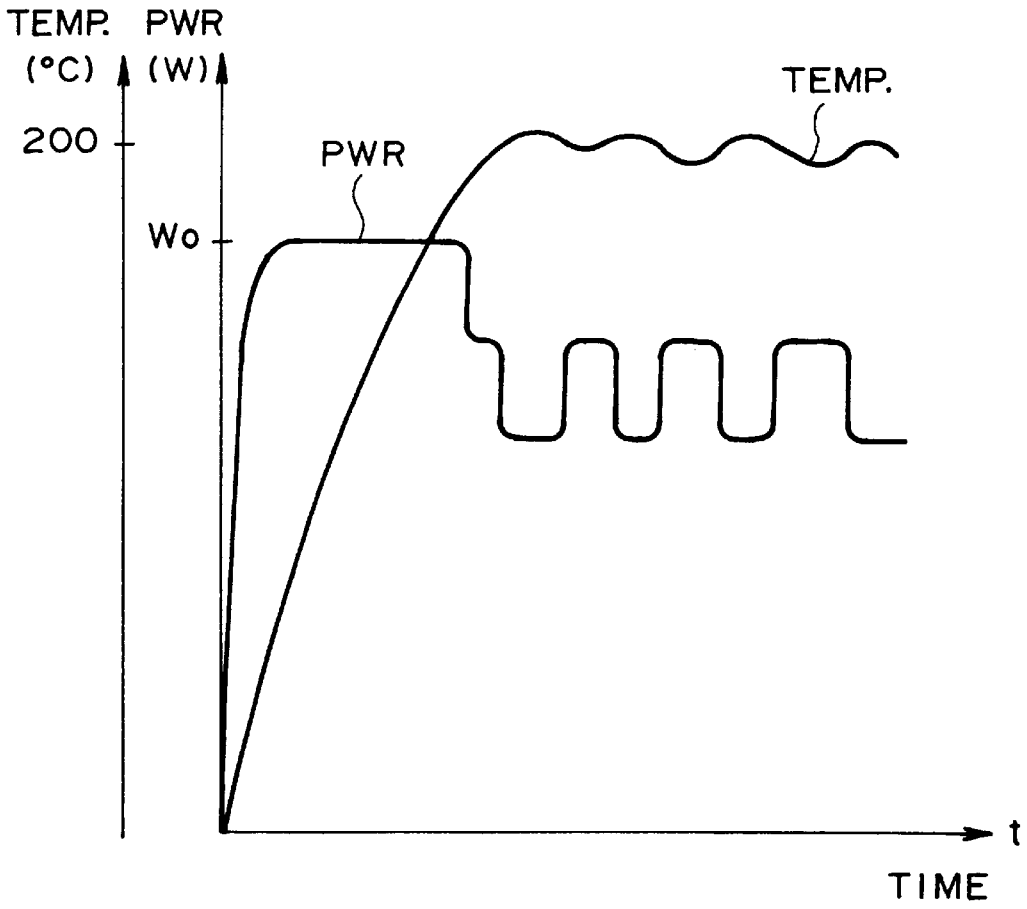
FIG. 10 is a graph showing the correlation between the power supply and heater temperature during a fixing operation, in the first embodiment of the present invention.
Figure 11:
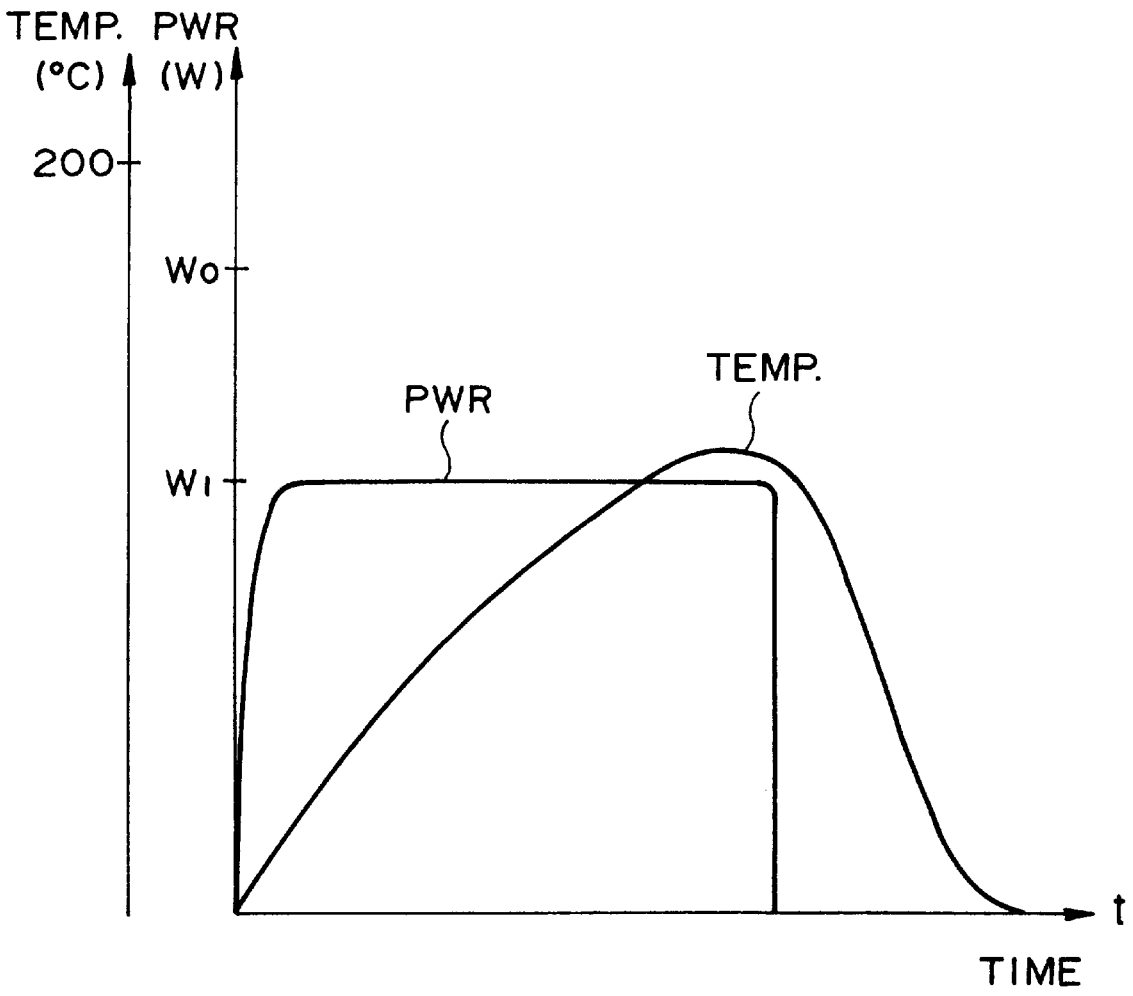

Thus, the power to be supplied to the heater 31 while the film and pressure roller are rotating immediately after the main power switch is turned on its rendered smaller than that supplied during the warm-up period at the beginning of a fixing operation, so that the temperature increase curve for the heat generating resistor 42 becomes gentler, as shown in FIG. 11, than the temperature increase curve for a fixing operation shown in FIG. 10. As a result, the amount of the warp toward the surface C is reduced, and the pressure nip trace can be removed without deforming the heater 31.

The reason why the power supply to the heater 31 is started a predetermined time after the power supply to the main assembly is turned on is to detect the amount of the film 35 shift and to determine whether or not the shift is within a normal range. However, the power may be supplied to the heater 31 at the same time as the main power switch is turned on.

Figure 9:
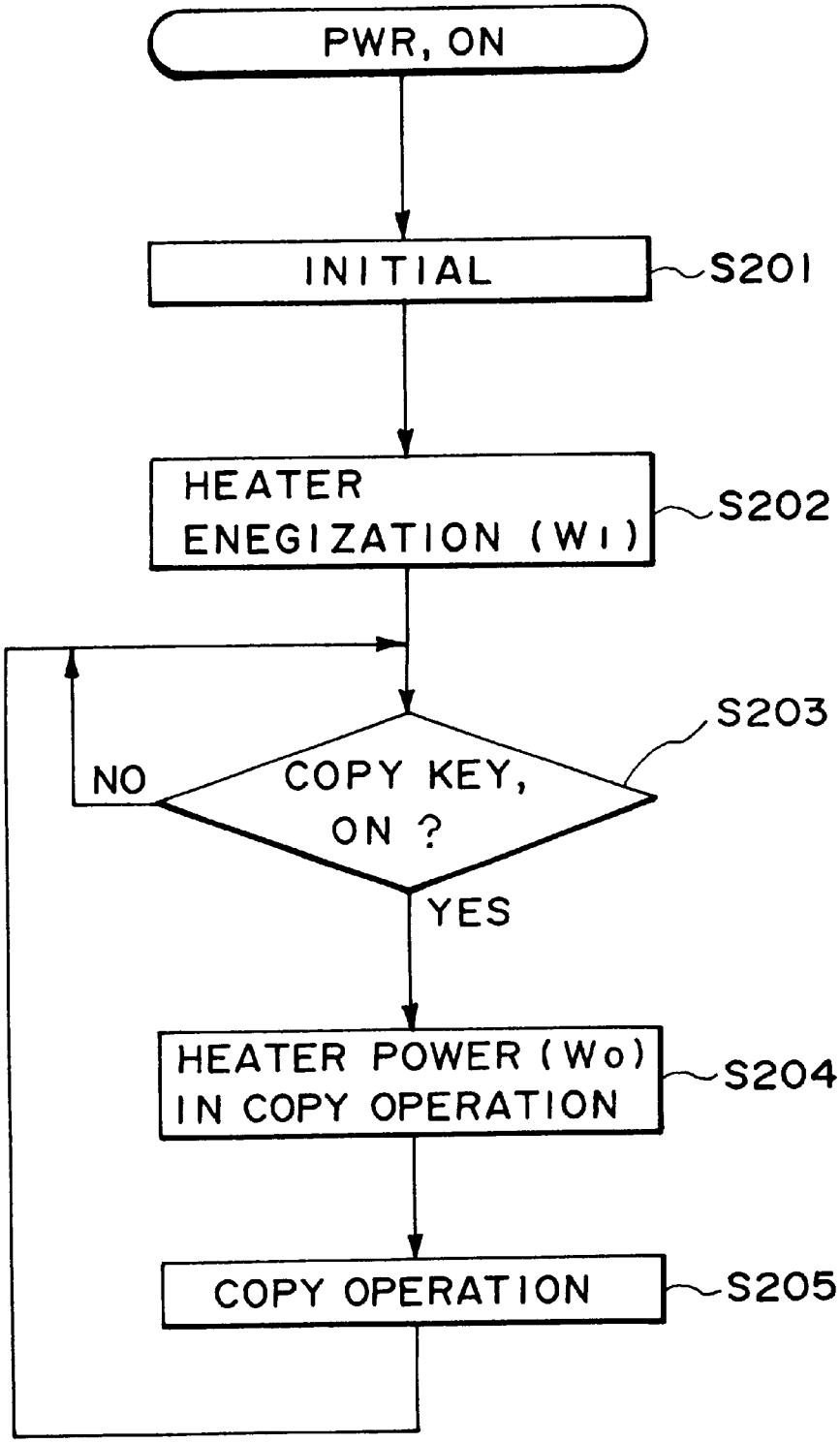
FIG. 9 is a flow chart for controlling the image forming apparatus in the first embodiment of the present invention.

Referring to FIG. 8, when there is no input from the copy key, the apparatus enters a standby state, in which the power is not supplied to the heater (step S203 in FIG. 9). When there is an input from the copy key, a copying operation is initiated, and at the same time, the power $W_0$ begins to be supplied to the heater 31 (step S203 in FIG. 9). Therefore, the power supply to the heater 31 is controlled so that the heater temperature detected by the thermister is maintained at the predetermined fixing temperature. In this step, the power supplied to the heater 31 is set up so as to satisfy the following formula:

$$W_0>W_1$$

Also, in order to prevent the heater temperature from being excessively increased by the power applied when the power to the main assembly is turned on, the power supply to the heater 31 is also controlled during the pre-rotation of the pressure roller so that after the heater temperature detected by the thermistor reaches the target temperature for the fixing operation, the temperature of heater 31 is maintained at that level. Thus, the heater temperature is controlled so as to remain stable during the period immediately after the power to the main assembly is turned on, and also, during a copying operation.

Further, in the apparatus in this embodiment, when a copy signal is not inputted to the controller 101 for a predetermined period after the ending of the pre-rotation of the pressure roller immediately after the main power switch is turned on, or when a copy signal is not inputted for a predetermined period after the ending of a fishing operation, the power switch is automatically turned off. Therefore, when the apparatus is left Mused for a long time, a copying operation has to be preceded by a step in which the main power switch is turned on, and this step removed the nip trace on the pressure roller as described above.

Further, after the ending of the pre-rotation of the pressure roller immediately after the main power switch is turned on, the heater 31 will have been warmed up to a certain degree; therefore, tile deformation of the heater 31, which occurs when a large amount of power is applied, is smaller than when the heater 31 is cold. Accordingly, a larger amount of power can be applied to shorten the time necessary for the target temperature to be reached.

Next, referring to FIGS. 8, 10, 12 and 13, the second embodiment of the present invention will be described. The same sections or components as those in the first embodiment are designated by the same referential codes to avoid repeating the same descriptions.

In this embodiment, the power supplied to the heater 31 immediately after the main power switch is turned on is controlled so that the target heater temperature for this period remains lower than that for the period of an actual copying operation.

Referring to FIGS. 8, 10, 12 and 13, the power supply sequence for the heater in this embodiment will be described.

Figure 12:
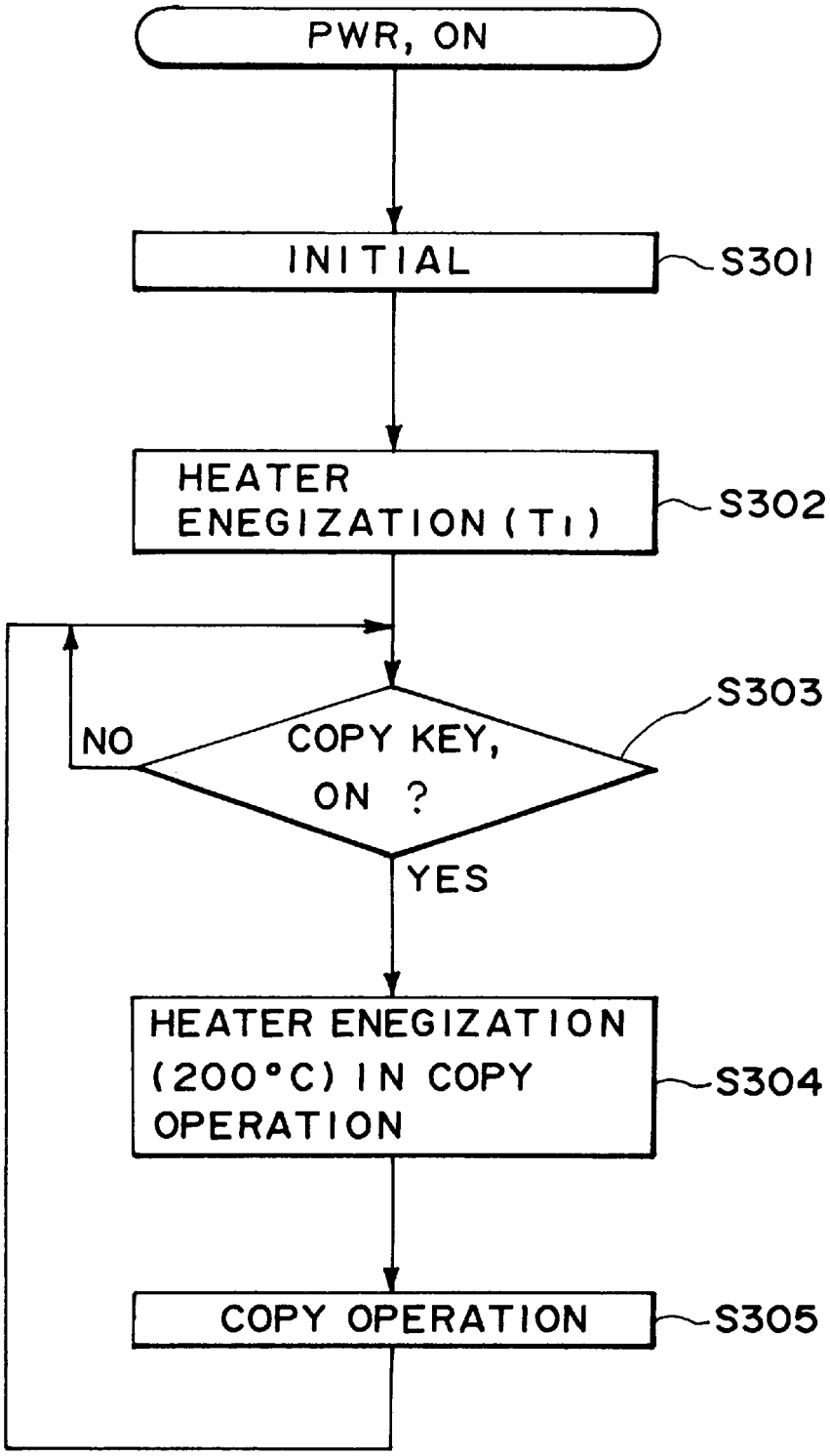
FIG. 12 is a flow chart for controlling the image forming apparatus in the second embodiment of the present invention.
Figure 13:
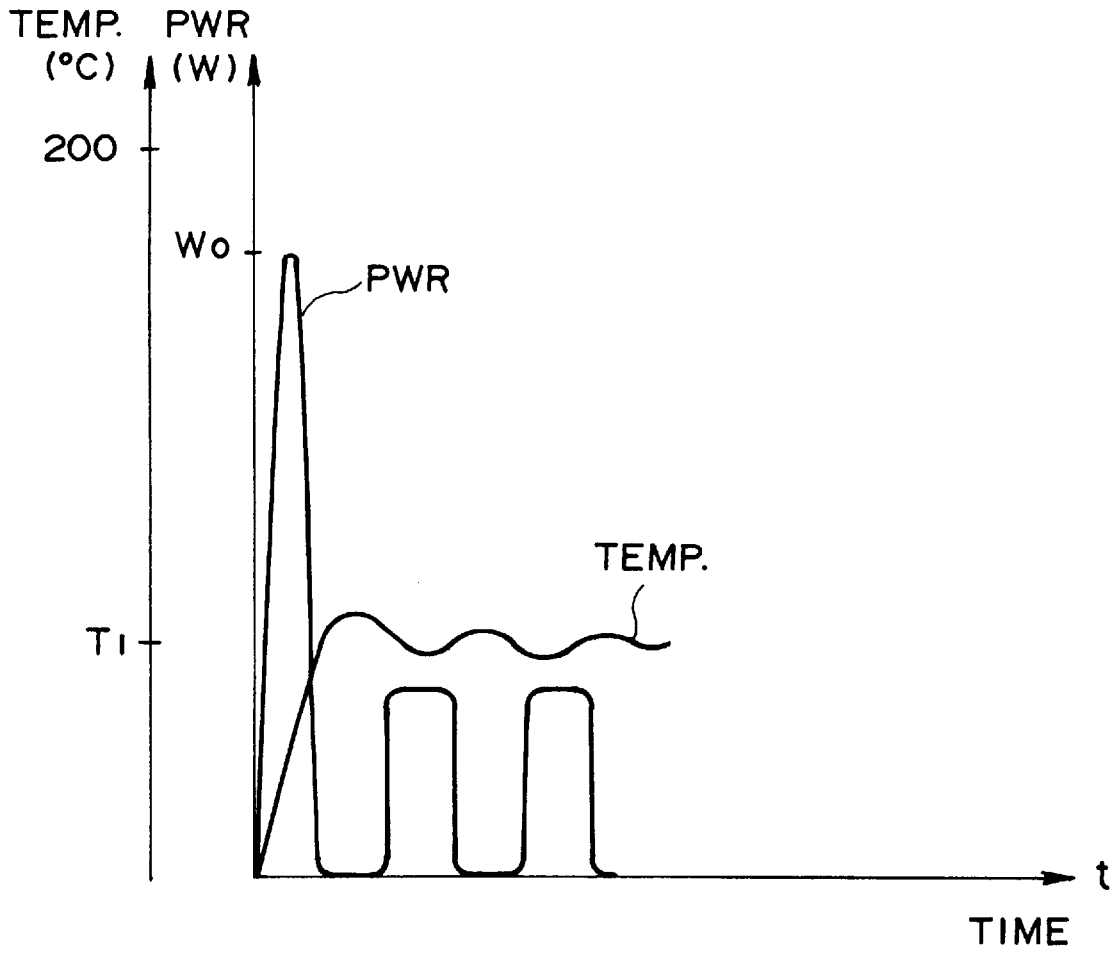

To begin with, referring to FIG. 8, the moment the power switch of the apparatus main assembly is turned on, the main motor M1 begins to be rotated at a predetermined revolution for a predetermined duration and the stepping motor M2, which is the motor for the optical system, is driven to move the optical system to the home position (step S301 in FIG. 12). The application of power to the heater 31 is started a predetermined time after the main power switch is turned on, as shown in FIG. 8, and at this time, the target temperature for the temperature control is set at a temperature $T_1$. which is lower than the target temperature for a normal copying operation (step S302 in FIG. 12). Therefore, the temperature increase curve for the heat generating resistor 42 remains at a lower level, as shown in FIG. 13, than the temperature increase curve for a fixing operation shown in FIG. 10. As a result, the amount of the expansion on the surface C side is reduced.

Further, the initial power supply at the time when the power switch is turned on is set at $W_0$, but since the period during which the power is supplied at the level of $W_0$ is extremely short, the heater deformation is small.

Also referring to FIG. 8, when three is no input from the copy key, the apparatus enters a standby state, in which the power is not supplied to the heater (step S303 in FIG. 13). When there is an input from the copy key, a copying operation is initiated, and at the same time, the power to the heater 31 begins to be supplied, with the target temperature being set at $T_0$−200° C. (steps S304 and S305 in FIG. 13). At this time, the target temperature Is set so as to satisfy the following formula:

$$T_0 > T_1$$

($T_0$: target temperature during copying operation)

Thus, the heater temperature is regulated using such a phase control as described above so that the heater temperature remains stable during the period immediately after the main power switch is turned on, and also, during the period of an actual copying operation.

As described above, the target heater temperature for the period of the pre-rotation of the pressure roller immediately after the main power switch is turned on is set at a lower level; therefore, the nip trace can be removed without causing the heater 31 to deform.

While the invention has boon described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an unfixed image on a recording material;

a heater for generating heat upon reception of electric energy;

a film having one side contacting to said heater and the other side movable together with the recording material carrying an unfixed image while the one side is in contact with said heater;

a pressure roller for forming a nip with said heater with said film therebetween; and a main power switch for actuating said apparatus, wherein said pressure roller starts to rotate when said main power switch of the apparatus is actuated, and then stops, and wherein upon a first input of an image forming operation signal after said main power switch is actuated, it restarts the rotation to start a first image fixing operation.

2. An image forming apparatus according to claim 1, further comprising a power source for supplying the electric energy to said letter during the rotation of said pressure roller which occurs upon the main power switch is actuated.

3. An image forming apparatus in accordance with claim 2, further comprising a temperature detecting element for detecting the temperature of said heater, and electric energy supply controlling means for controlling the electric energy supply to said heater so that the temperature detected by said temperature detecting element is maintained at a fixing temperature during a fixing operation; wherein said power source supplies a smaller amount of electric energy to said heater during the rotation of said pressure roller upon the main power switch is actuated, than the electric energy supplied at the beginning of the fixing operation.

4. An image forming apparatus in accordance with claim 3, wherein a duty ratio of the power supply to said heater at the beginning of the fixing operation is 100%.

5. An apparatus according to claim 1, wherein said main power switch is automatically deactuated, when the image forming signal is not inputted for a predetermined period of time after termination of rotation of said pressure roller when said main power switch is actuated or after termination of the fixing operation.

* * * * *

UNITED STATES PATENT AND TRADEMARK OFFICE

CERTIFICATE OF CORRECTION

PATENT NO. : 5,982,503

DATED : November 9, 1999

INVENTOR(S): KAZUKI MIYAMOTO, ET AL.

It is certified that error appears in the above-identified patent and that said Letters Patent is hereby corrected as shown below:

COLUMN 1:
Line 14, "In" should read --in--.

COLUMN 3:
Line 36, "A, A±, B or B±" should read --A, A*, B or B*--.

COLUMN 10:
Line 1, "Is" should read --is--;
Line 34, "when" should read --immediately after--;
Line 36, "stops, and wherein upon" should read --stops before--;
Line 39 "after said main power switch" should read –thereafter and wherein after the first input of the image forming operation signal--
thereafter and wherein after the first input of the image forming operation signal--;

Line 44, "letter" should read --heater--;
Line 45, "upon" should read --when--; and

UNITED STATES PATENT AND TRADEMARK OFFICE

CERTIFICATE OF CORRECTION

PATENT NO. : 5,982,503

DATED : November 9, 1999

INVENTOR(S): KAZUKI MIYAMOTO, ET AL.

It is certified that error appears in the above-identified patent and that said Letters Patent is hereby corrected as shown below:

COLUMN 10 (Cont.):

Line 54, "upon" should read --when--.

Signed and Sealed this

Fourteenth Day of November, 2000

*Attest:*

Q. TODD DICKINSON

*Attesting Officer*

*Director of Patents and Trademarks*